United States Patent [19]

Corbett

[11] 3,940,281

[45] Feb. 24, 1976

[54] ASPHALT COMPOSITION UTILIZING ASPHALTENE CONCENTRATE

[75] Inventor: Luke W. Corbett, Mountainside, N.J.

[73] Assignee: Exxon Research and Engineering Company, Linden, N.J.

[22] Filed: Nov. 23, 1973

[21] Appl. No.: 418,663

[52] U.S. Cl. ..... 106/278; 208/23

[51] Int. Cl.[2] ..... C10C 3/00

[58] Field of Search ..... 106/273, 278, 279, 27; 208/8, 23, 45, 75

[56] References Cited

UNITED STATES PATENTS

| | | | |
|---|---|---|---|
| 1,233,101 | 7/1917 | Moniwa | 106/278 UX |
| 2,200,484 | 5/1940 | Batchelor | 106/278 UX |
| 2,366,657 | 1/1945 | Sorem | 106/278 X |
| 2,862,869 | 12/1958 | Illman | 106/278 X |
| 2,909,441 | 10/1959 | Pickell | 106/278 X |
| 2,913,389 | 11/1959 | Heithans, Jr. | 208/23 |
| 2,940,920 | 6/1960 | Garwin | 106/278 X |
| 2,970,099 | 1/1961 | Illman | 106/278 X |
| 3,072,559 | 1/1963 | Corbett | 208/45 |
| 3,087,887 | 4/1963 | Corbett et al. | 208/45 |
| 3,093,573 | 6/1963 | Corbett | 208/23 X |
| 3,303,122 | 2/1967 | Doelman | 208/45 |
| 3,360,455 | 12/1967 | Corbett et al. | 208/22 |
| 3,563,778 | 2/1971 | Corbett et al. | 106/278 |
| 3,793,189 | 2/1974 | Corbett | 208/23 |

FOREIGN PATENTS OR APPLICATIONS

| | | |
|---|---|---|
| 2,258,133 | 6/1973 | Germany |

OTHER PUBLICATIONS

Barth, *Asphalt Science and Technology*, New York, Gordon and Breach Science Publishers, 1962; pp. 430–460 relied on.

Abraham, Asphalts and Allied Substances, Vol. I, New York, D. Von Nostrand Co., Inc., 1960; pp. 52–63, 71–78 and 113–126 relied on.

*Primary Examiner*—Theodore Morris

*Attorney, Agent, or Firm*—Byron O. Dimmick

[57] ABSTRACT

An asphaltene concentrate obtained by liquid hydrocarbon fractionation of an asphaltic residuum is blended with a petroleum fraction containing alkylated naphthenes and/or alkylated aromatics such as a vacuum distilled gas oil, a naphthene-aromatic fraction of a gas oil, or a solvent extract of a lubricating oil fraction, thereby producing a high quality paving composition.

6 Claims, 3 Drawing Figures

COMPARISON OF VARIOUS RESIDUAL FRACTIONS FROM LAGUNILLAS CRUDE

S = Saturates

NA = Naphthene Aromatics

PA = Polar Aromatics

A = Heptane Insoluble Asphaltenes

PENTANE FRACTIONATION OF
IRANIAN HEAVY RESIDUUM

S= Saturates
NA= Napthene Aromatics
PA= Polar Aromatics
A= Heptane Insoluble Asphaltenes

BLENDING OF TIA JUANA RESIDUA COMPONENTS

ASPHALT COMPOSITION UTILIZING ASPHALTENE CONCENTRATE

FIELD OF THE INVENTION

This invention relates to the preparation of an asphaltic composition that is useful in paving formulations. The composition is prepared by treating a petroleum residuum with a liquid hydrocarbon that will yield an asphaltene concentrate that contains an appreciable proportion of polar aromatic compounds in addition to the asphaltenes, and then blending that asphaltene concentrate with a relatively highboiling petroleum fraction that contains alkylated naphthenes and/or alkylated aromatics. In the practice of this invention, it is possible to obtain from a particular crude stock as asphalt having improved specification qualities and higher asphaltene content than a conventional asphalt obtained from that crude while at the same time producing a lower yield of asphalt based on that crude, thereby giving higher yields of fractions that are useful for other purposes.

DESCRIPTION OF THE PRIOR ART

It is known, as taught for example in U.S. Pat. No. 3,087,887, to separate asphaltenes from a petroleum residuum and to blend those asphaltenes with other asphaltic fractions to prepare an improved asphalt composition. It is also known to blend asphaltenes with a residual fuel oil to prepare asphaltic compositions; see for example, Canadian Pat. No. 828,042. Other patents that teach the blending of asphaltenes with bituminous material include U.S. Pat. No. 2,909,441 and British Pat. No. 990,953.

SUMMARY OF THE INVENTION

In contrast with the prior art wherein asphaltenes as such have been blended with other petroleum fractions, the present invention employs an asphaltene concentrate which contains in addition to the asphaltenes an appreciable percentage of an additional component of the petroleum residuum, namely, a fraction known as polar aromatics. One advantage accruing from the present invention is that, because of the presence of appreciable percentage of polar aromatics, the asphaltenes as such are more easily blended and dispersed with other components in preparing the finished asphalt composition.

DETAILED DESCRIPTION OF THE INVENTION

In the accompanying drawings, FIG. 1 is a chart showing the composition of a conventionally vacuum distilled residuum as compared with the composition of a high vacuum distilled residuum, a propane precipitated asphalt, an asphaltene concentrate, and a heptane insoluble asphaltene fraction.

As described in *Analytical Chemistry*, Volume 41, page 576 (April, 1969), a petroleum asphalt contains four generic components, namely, saturates, naphthene-aromatics, polar aromatics, and asphaltenes. Asphaltenes are brown to black solid materials of a very friable nature and are characterized as being insoluble in heptane. The present invention employs, not the asphaltenes alone, but an asphaltene concentrate containing from 40 to 90% of asphaltenes and from 10 to 60% of polar aromatics. There should be no more than 10% of naphthene aromatics present in the asphaltene concentrate and preferably no naphthene aromatics as defined in the aforementioned article in *Analytical Chemistry*.

Figure 1:
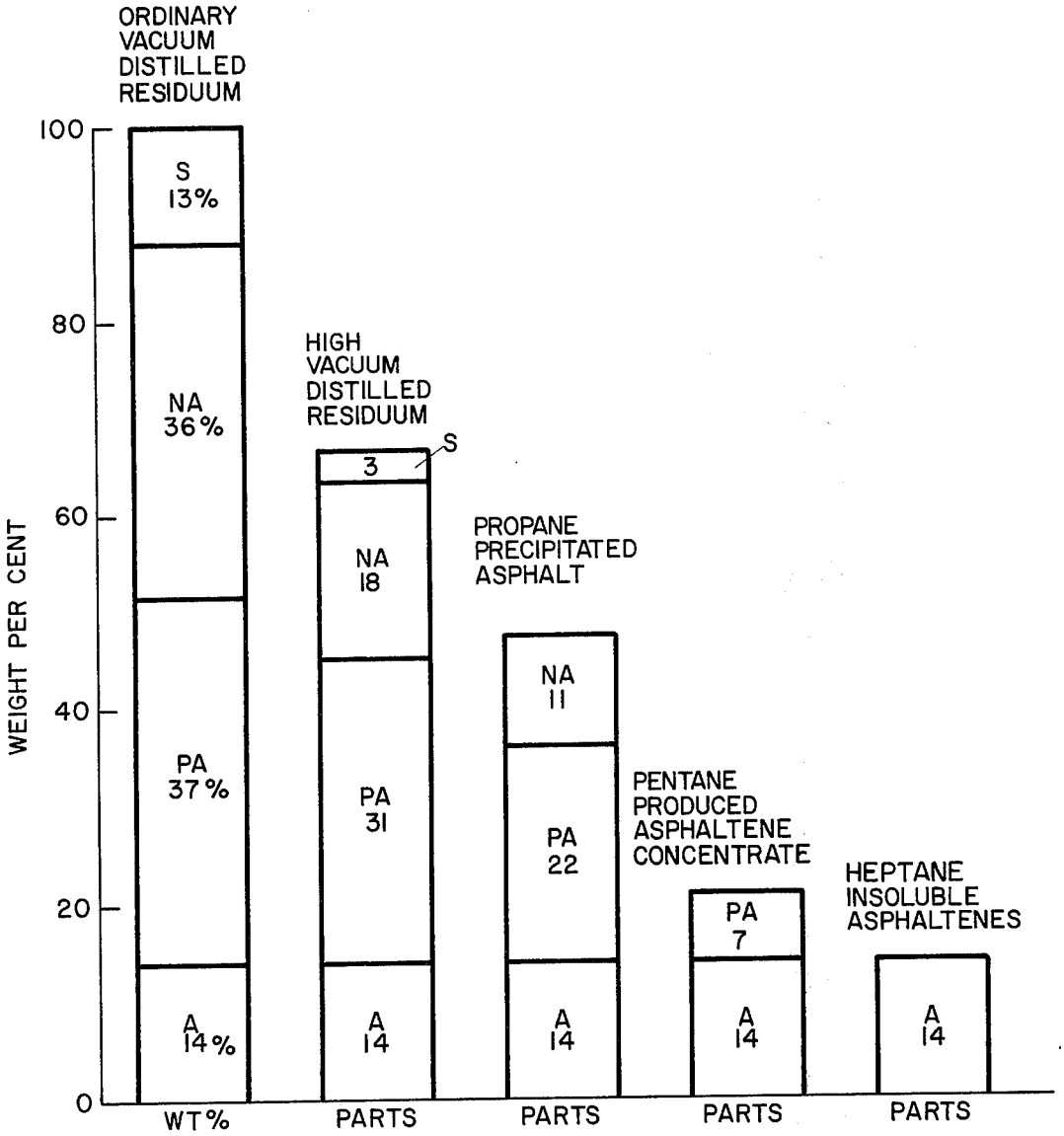

A comparison of the compositions of various residual fractions from a representative crude oil, in this case Lagunillas crude, is shown in the bar graphs of FIG. 1. In the first bar graph the numbers are weight percentages, while in each of the remaining four the numbers are parts of the whole, by weight. In terms of the generic components a conventionally vacuum distilled residuum will have 13 wt. % saturates, 36 wt. % naphthene aromatics, 37 wt. % polar aromatics and 14 wt. % heptane-insoluble asphaltenes. A high vacuum distilled residuum from the same crude will have 3 parts of saturates, 18 parts of naphthene aromatics, 31 parts of polar aromatics, and 14 parts of heptane-insoluble asphaltenes. A propane precipitated asphalt will have no saturates, 11 parts of naphthene aromatics, 22 parts of polar aromatics and 14 parts of heptane-insoluble asphaltenes. A pentane-produced asphaltene concentrate consists of 7 parts of polar aromatics and 14 parts of heptane-insoluble asphaltenes.

One process for obtaining the desired asphaltene concentrate involves solvent fractionation of an asphaltic residuum with pentane or isopentane at a temperature within the range of about 175° to 400°F. and at elevated pressures, e.g., 75 to 500 psia, using the procedure taught in U.S. Pat. No. 2,940,920. The asphaltene concentrate will have a melting point higher than 300°F. A preferred asphaltene concentrate contains from 20 to 45 wt. % of polar aromatics and from 55 to 80% of asphaltenes.

Figure 2:
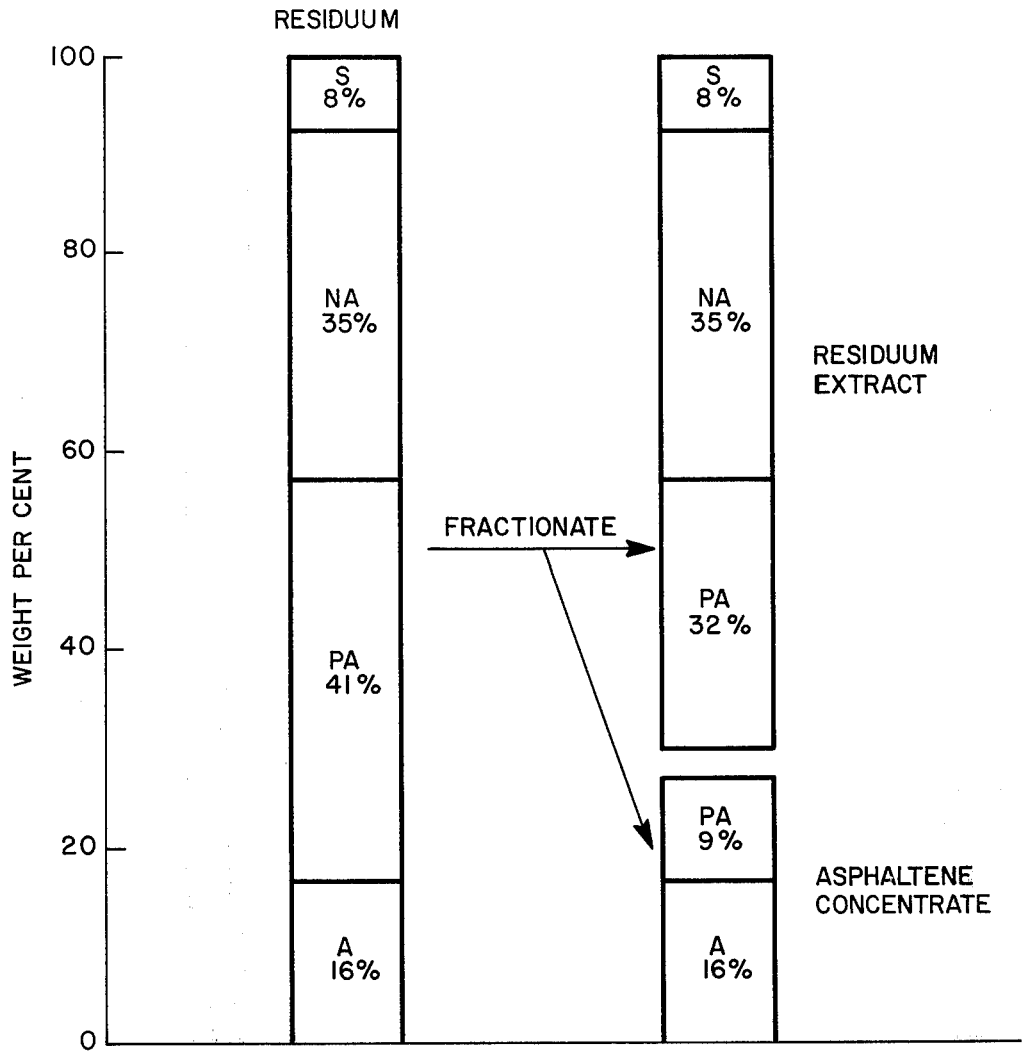
FIG. 2 is a chart depicting the composition of a residuum as compared with that of an asphaltene concentrate obtained from that residuum and the residuum extract remaining after separating the asphaltene concentrate.

FIG. 2 comprises two bar graphs showing the composition of a heavy residuum from an Iranian crude oil as compared with the asphaltene concentrate and remaining residuum extract obtained from that residuum by pentane fractionation of that residuum at elevated temperatures and pressures as taught for example in U.S. Pat. No. 2,940,920, (e.g., at 200°–375°F. and 75–425 psia with 4/1 pentane to residuum ratio). All percentages are based on the starting residuum. As shown in the chart, the saturates, the naphthene aromatics, and slightly more than ¾ of the polar aromatics remain in the residuum extract, and the balance of the polar aromatics are combined with the asphaltenes to make up the asphaltene concentrate.

The starting residuum had an API gravity of 5.9° and a penetration of 77°F. of 50, and the residuum extract had an API gravity of 11.0° and a viscosity of 2300 SUS at 210°F. The asphaltene concentrate had a specific gravity of 1.13 and a softening point of 351°F.

As shown below, the separation gives an extract relatively low in metals and an asphaltene concentrate relatively high in metal content compared with the starting residuum, thereby improving the suitability of the residuum extract (deasphalted oil) as a feed to a catalytic process.

| METAL CONTENT, PARTS PER MILLION | Residuum | Extract | Asphaltene Concentrate |
|---|---|---|---|
| Nickel | 120 | 40 | 344 |
| Vanadium | 372 | 89 | 1155 |
| Iron | 16 | 2 | 55 |

To prepare the compositions of the present invention, one volume of the asphaltene concentrate is blended with from one to four volumes of a vacuum gas oil, an aromatic extract fraction of a distillate or residual lubricating oil fraction, or a naphthene-aromatic fraction derived from a gas oil. The obtaining of aromatic extracts from lubricating oil fractions is well known in the art and involves the use of such solvents as phenol, cresol, aniline, sulfur dioxide, furfural and the like. The nature of the extract obtained will depend to some extent upon the crude from which the lube oil fraction has been obtained as well as upon the intensity of the extraction treatment. An extract having a viscosity index below about 30 is suitable for the purposes of the present invention although, more advantageously, extracts having a lower viscosity index, for example below 0, will be used. The extracts can be obtained from lubricating oil fractions of paraffinic, naphthenic, or mixed asphaltic based types of crude oils.

As used in the present invention, vacuum gas oil is defined as a petroleum distillate having an atmospheric equivalent boiling range of about 600° to 1200°F., preferably about 750° to 950°F. Two representative gas oil fractions are one having a boiling range of 750° to 850° atmospheric equivalent vapor temperature and another having a boiling range of about 850° to 950°F. atmospheric equivalent vapor temperature. The defined boiling ranges are those determined by ASTM D 1160-61. It is convenient to designate a vacuum gas oil in terms of its atmospheric equivalent boiling range by use of the initials AEVT (atmospheric equivalent vapor temperature) e.g., 850–950°F. AEVT.

The naphthene aromatic fraction of gas oil can be obtained by chromatographic adsorption-desorption procedures well known in the art.

The characteristic that is common to the use of a vacuum gas oil, a naphthene-aromatic fraction of a gas oil, or a solvent extract of a lubricating oil fraction is that all of them contain alkylated naphthenes and/or alkylated aromatic hydrocarbons and usually mixed molecules containing both naphthene and aromatic rings.

This invention can be more fully understood by reference to the following examples which include preferred embodiments. These are offered by way of illustration only and are in no way intended to limit the scope of the invention.

EXAMPLE 1

A Tia Juana medium asphaltene concentrate containing 66 wt. % of asphaltenes and 34 wt. % of polar aromatics was obtained by controlled high temperature normal pentane fractionation of a residuum from a Tia Juana crude oil. A blend was prepared consisting of 42% of the asphaltene concentrate and 58% of a vacuum gas oil (800°–900°F. AEVT) from Tia Juana crude. The properties of the resulting blend and of a straight reduced asphalt from Tia Juana crude are compared in Table I which follows:

TABLE I

| BLENDING OF TIA JUANA MEDIUM ASPHALTENE CONCENTRATE IN MAKING PAVING ASPHALT<br>Composition, wt. % | | |
|---|---|---|
| Tia Juana Asphaltene concentrate | 42 | |
| Tia Juana vacuum gas oil 800–900°F. (AEVT) | 58 | |
| Tia Juana Straight Reduced Asphalt | | 100 |
| Physical Properties | | |
| Penetration at 77°F. | 90 | 91 |
| Pen Ratio (39.2/77°) | 61 | 32 |
| Absolute Viscosity at 140°F. | 3300 | 1807 |
| Viscosity SFS at 275°F. | 205 | 190 |
| Ductility at 39.2 (5 cm/min.) | | 6.5 |
| Oliensis Spot | Negative | Negative |

EXAMPLE 2

An asphaltene concentrate was obtained by the controlled normal pentane treatment of a residuum from Tia Juana crude oil. Blends were prepared using 40% of this concentrate and 60% of a vacuum gas oil from Hawkins crude, the naphthene aromatic fraction of the same vacuum gas oil and a phenol extract from a lubricating oil fraction. The properties of the resulting blends in comparison with the properties of the straight reduced asphalt from the same Hawkins crude and as compared with a blend of a propane precipitated asphalt and Hawkins vacuum gas oil blended to the same penetration are given in Table II which follows:

TABLE II

| Composition Wt. % | 1 | 2 | 3 | 4 | 5 |
|---|---|---|---|---|---|
| Asphaltene Concentrate | 40 | 40 | 40 | | |
| Vacuum gas oil | 60 | | | 25 | |
| Lube Extract | | 60 | | | |
| Naphthene-Aromatics | | | 60 | | |
| Propane-precipitated Asphalt | | | | 75 | |
| Straight Reduced Asphalt | | | | | 100 |
| Properties | | | | | |
| Pen. at 77°F. mm/10 | 90 | 90 | 90 | 90 | 90 |
| Pen. Ratio (39.2/77°F.) % | 36 | 42 | 38 | 24 | 31 |
| Abs. Viscosity at 140°F. poises | 3420 | 1700 | 2275 | 1300 | 1725 |
| Viscosity at 275°F., centistokes | 365 | 382 | 390 | — | 410 |

The gas oil was obtained as the second side stream from the vacuum tower used in distilling the Hawkins crude and had an approximate distillation range of 700° to 925°F. (AEVT).

The naphthene aromatic fraction of the gas oil was obtained by chromatographic adsorption and desorption, the yield being about 50 wt. % of the original gas oil. The recovered fraction had an average molecular weight of about 493 as determined by vapor pressure osmometry and an average carbon/hydrogen ratio of 8.1. The phenol extract had an API gravity of 26.5° and contained about 56% of naphthene aromatics. About 25% of the carbon atoms in the hydrocarbons constituting the extract were determined to be aromatic carbons, i.e., present in aromatic rings.

The data in Table II clearly illustrate advantages gained in the practice of the present invention. Each of the compositions, 1, 2 and 3 shows an improved penetration ratio over the straight reduced asphalt (composition 5) or over the blend of vacuum gas oil and propane-precipitated asphalt (composition 4).

Figure 3:
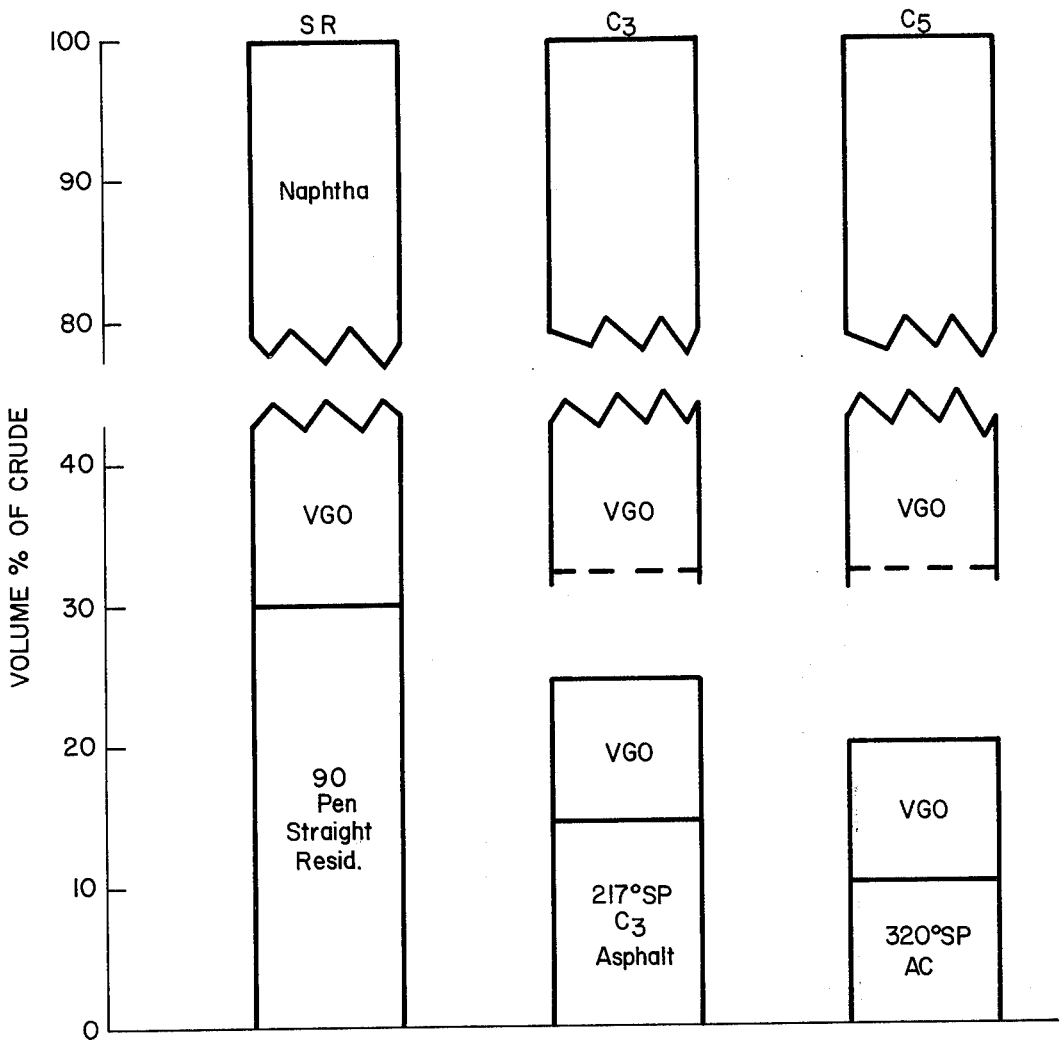
FIG. 3 is a chart showing that by the practice of the present invention it is possible to obtain an asphalt with higher penetration ratios and higher viscosities than when producing a straight run asphalt of the same penetration value from the same crude.

FIG. 3 shows diagrammatically one advantage that is afforded by the present invention as contrasted with the conventional production of asphalt by straight reduction of an asphaltic crude or by propane precipitation of the asphalt. The break in each of the three bar graphs corresponds roughly with the discontinuity in the percentage scale at the lefthand margin. Intermediate cuts, including kerosene and light gas oil are not shown, and the yields of naphtha and heavy gas oil are not given as definite values as these will vary depending on the cut points. The line delineating the cutoff point of vacuum gas oil (VGO) in the first graph is positioned lower than the lines marking the cutoff point for vacuum gas oil in the other graphs to indicate that the first vacuum gas oil can have a higher cutoff temperature (e.g., 1150°F. AEVT) than that of the other vacuum gas oils.

As shown in the first bar graph labelled SR, there is a yield of about 30 volume percent, based on crude, of 90 penetration asphalt when the asphalt is obtained by straight reduction (vacuum distillation) of a Tia Juana medium crude. The second bar graph, labelled $C_3$, shows that the residuum of that same crude is subjected to propane deasphalting there is a yield of about 15 volume percent of propane-precipitated asphalt ($C_3$ asphalt) of 217°F. softening point. Blending 15 volumes of this latter asphalt with 9 volumes of 850°–950°F. AEVT vacuum gas oil will give 24 volumes of a blend that will have the same 90 penetration at 77°F. as the straight reduced asphalt from the same crude.

Referring now to the third bar graph, labelled $C_5$, as asphaltene concentrate (labelled AC) containing 66 wt. % of heptane-insoluble asphaltenes and 34 wt. % of polar aromatics, and having a softening point of 320°F. is obtained in a yield of about 10 vol. % based on the crude, by high temperature pentane treatment (e.g., at 350°F. and 425 psia pressure) of the residuum from the same Tia Juana crude oil. In order to prepare an asphalt composition with the same 90 penetration at 77°F. as the straight reduced asphalt from the same crude, 10 volumes of the asphaltene concentrate is blended with 11 volumes of the 850°–950°F. AEVT vacuum gas oil to give 21 volumes of the desired composition.

The properties of the three asphalts discussed above are shown in Table III which follows:

TABLE III

COMPARISON OF ASPHALTS FROM TIA JUANA CRUDE

| | Reduction Method | | |
|---|---|---|---|
| | SR | $C_3$ | $C_5$ |
| Penetration at 77°F. mm/10 | 90 | 90 | 90 |
| Pen Ratio (39.2/77°F.) % | 35 | 45 | 52 |
| Absolute Viscosity at 140°F., poises | 1720 | 2100 | 2310 |
| Yield Based on Crude Vol. % | 30 | 24 | 21 |

It will be seen from Table III that the blending of the asphaltene concentrate with a vacuum gas oil provides a 90 penetration asphalt with a higher penetration ratio and a higher viscosity at 140°F. than a straight run asphalt from the same crude while yielding only 21 volume percent of asphalt based on crude versus 30 volume % when producing straight run asphalt of the same penetration. Higher penetration ratios and higher viscosities are desirable from the standpoint of specification quality, permitting upgrading of lower quality stocks by blending therewith. See ASTM STP 532, June 1973. The lower yield based on crude provides an economic advantage because bottom fractions are usually accounted for at lower dollar values than the gas oil fractions.

Although the obtaining of the desired asphaltene concentrate for use in the practice of this invention has been exemplified by the treatment of a residuum with pentane or isopentane, which are the preferred hydrocarbons for the fractionation, the invention is not limited thereto in this respect because it is also possible to obtain an asphaltene concentrate having the defined proportions of asphaltenes and polar aromatics by elevated temperature and pressure treatment of residua with other hydrocarbons of from 4 to 9 carbon atoms, using the procedure taught in U.S. Pat. No. 2,940,920. Such other hydrocarbons include paraffins, olefins, cycloparaffins, aromatics, and mixtures thereof, e.g., hexane, octylene, toluene, methyl-cyclopentane, etc.

What is claimed is:

1. An asphaltic composition comprising one volume of an asphaltene concentrate containing from 40 to 90 wt. % of heptane-insoluble asphaltenes and from 10 to 60 wt. % of polar aromatics *derived from an asphaltic residuum*, blended with from one to four volumes of a petroleum fraction selected from the group consisting of an aromatic solvent extract of a lubricating oil fraction, said extract having a viscosity index below 30, a vacuum gas oil having a boiling range within the limits of about 600° to 1200°F. atmospheric equivalent vapor temperatures, and a naphthene-aromatic fraction of a gas oil.

2. Composition as defined by claim 1 wherein said asphaltene concentrate also contains up to 10 wt. % of naphthene-aromatics.

3. Compositions as defined by claim 1 wherein said asphaltene concentrate contains from 55 to 80 wt. % of heptane insoluble asphaltenes and from 20 to 45 wt. % of polar aromatics.

4. Composition as defined by claim 1 wherein said asphaltene concentrate has been obtained by treatment of an asphaltic residuum with normal pentane or isopentane or a mixture thereof at an elevated temperature and pressure.

5. A process for preparing an asphaltic composition which comprises the steps of subjecting an asphaltic residuum to a solvent fractionation with a $C_4$ to $C_9$ hydrocarbon under conditions of elevated temperature and pressure whereby there is obtained an asphaltene concentrate containing from 40 to 90 wt. % of heptane insoluble asphaltenes and from 10 to 60 wt. % of polar aromatics; thereafter blending one volume of said concentrate with from one to four volumes of a petroleum fraction containing alkylated naphthenes and/or alkylated aromatics, said fraction being selected from the group consisting of an aromatic solvent extract of a lubricating oil, a vacuum gas oil, and a naphthene aromatic fraction of a gas oil; whereby there is obtained an asphalt of improved specification quality in lower yield based on crude oil volume as compared with an asphalt of the same penetration grade obtained from the crude oil by conventional distillation.

6. Process as defined by claim 5 wherein the hydrocarbon used in the solvent fractionation is normal pentane or isopentane or a mixture thereof.

* * * * *